United States Patent [19]

Jeschke

[11] Patent Number: 4,669,715

[45] Date of Patent: Jun. 2, 1987

[54] SHEET TURNING DEVICE FOR SMALL OFFSET PRINTING MACHINES OR PRINTING UNITS

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 806,707

[22] Filed: Dec. 9, 1985

[30] Foreign Application Priority Data

Dec. 8, 1984 [DE] Fed. Rep. of Germany ..... 3444848
Feb. 1, 1985 [DE] Fed. Rep. of Germany ..... 3503368

[51] Int. Cl.[4] ..... B65H 29/00

[52] U.S. Cl. ..... 271/65; 271/186; 271/225; 271/275; 271/291; 101/231

[58] Field of Search ..... 271/184, 185, 186, 34, 271/65, 225, 275, 291; 101/231, 232, 183, 408; 294/118; 198/405

[56] References Cited

U.S. PATENT DOCUMENTS 3,280,995 10/1966 Barkley ..... 198/405
3,358,595 12/1967 Lindemann ..... 101/183

FOREIGN PATENT DOCUMENTS 0135715 5/1979 Fed. Rep. of Germany ..... 101/231

*Primary Examiner*—Joseph J. Rolla
*Assistant Examiner*—David H. Bollinger
*Attorney, Agent, or Firm*—Herbert L. Lerner; Laurence A. Greenberg

[57] ABSTRACT

Sheet turning device for small offset printing machines, comprising a conveyor system with gripper bridges linking two adjacent small offset printing machines for transporting a sheet having at least one printing performed thereon from one of the small offset printing machines to the other, the conveyor system being formed of two endless conveyor strands extending parallel to one another and being twisted in the form of a Mobius band, one part of the conveyor system extending between pairs of sprockets and Mobius-band twist formed therein, while the other part of the conveyor system is located opposite the one part and extends rectilinearly, so that the sheet transported in the region of the one part of the conveyor system is turned around the longitudinal axis thereof as it is being transported.

7 Claims, 8 Drawing Figures

6
7
8
9
10
11
12
13
14
15
16
17
18
19
20

SHEET TURNING DEVICE FOR SMALL OFFSET PRINTING MACHINES OR PRINTING UNITS

The invention of relates to a sheet turning device for small offset printing machines or printing units.

In spite of their relatively simple construction, modern small offset printing machines have achieved a high level of automation. Pre-selection of print runs as well as automatic loading of masters or printing plates are examples of such automation. This high level of automation makes small offset printing machines especially suitable for economical printing of very small jobs of different types. Moreover, modern small offset printing machines, because of the relatively simple operation and maintenance thereof, can be operated by semi-skilled personnel.

To an increasing extent, demands are made by those of knowledge and experience in the field to economize on paper and postage costs by printing on both sides of the sheet. Academic theses or dissertations are examples of such very small printing jobs. The successive printing of both sides of a sheet using the same single-color offset printing machine is very time-consuming and, therefore, costly. In such cases, the advantage of the high level of automation of such small offset printing machines is no longer fully exploited. If two-color small offset printing machines were equipped with sheet turning or turnover devices of the type used with conventional regular-size offset machines, the cost would be disproportionately high when compared with the simplicity of small offset printing machines. Additionally, semi-skilled personnel would hardly be able to perform the re-setting of such reversing units which requires considerable expertise and care.

It is, accordingly, an object of the invention to provide a sheet-turning device which is of relatively simple construction and can be operated without difficulty by semi-skilled personnel. The sheet turning device must match or correspond to the modern level of automation of small offset printing machines.

With the foregoing and other objects in view, there is provided in accordance with the invention a sheet turning device for small offset printing machines, including a conveyor system with gripper bridges linking two adjacent small offset printing machines for transporting a sheet having at least one printing performed thereon from one of the small offset printing machines to the other, the conveyor system being formed of two endless conveyor strands extending parallel to one another and being twisted in the form of a Mobius band, one part of the conveyor system extending between pairs of sprockets and Mobius-band twist formed therein, while the other part of the conveyor system is located opposite the one part and extends rectilinearly, so that the sheet transported in the region of the one part of the conveyor system is turned around the longitudinal axis thereof as it is being transported.

The means for conveying or drawing the sheets may be either chains, bands or belts. A particular advantage is that both printing units may be operated with like masters or printing plates because the sheet is only turned over, i.e. not turned upside-down or tumbled.

Even for very small printing jobs, a second color is often required to be printed, for example, as a decorative color. This is possible when in accordance with another feature of the invention, a conveyor system is arranged so as to be pivotable through 180° into two operating positions, by pivoting the part having the Mobius-band twist therein into a first form and perfector printing position of the small offset printing machine, and by pivoting the rectilinear part into a multicolor single-side printing position. The pivoting of the conveyor system may be performed without difficulty by semi-skilled personnel.

In accordance with another feature of the invention, gripper bridges of the conveyor system are furnished with tong grippers.

If a conveyor system, twisted in accordance with a Mobius loop, for example, has six gripper bridges, each gripper bridge assumes a different position alternatingly for two sequential chain revolutions. In other words, if a gripper bridge has a roller lever on one side for control, this roller lever lies, for example, on the drive side with the first revolution, and on the operating side with the second revolution. Consequently, control means (cams) are provided on both sides. If one wished to employ only one cam, double roller levers must then be arranged at the gripper bridges which, however, cause particular difficulties in the construction thereof.

Thus, in accordance with another aspect of the invention, it is an object thereof to provide a sheet turning device which can operate with relatively simpler control means and is therefore considerably more economical to manufacture.

Therefore, in accordance with this aspect of the invention, there is provided a sheet turning device for small offset printing machines, including a conveyor system with gripper bridges linking two adjacent printing units for transporting a sheet having at least one printing performed thereon from one of the printing units to the other, the conveyor system being formed of two endless conveyor strands extending parallel to one another and being twisted in the form of a Mobius band, both an upper and a lower part of the conveyor system extending between respective pairs of sprockets and having a Mobius-band twist of 180° formed therein.

In accordance with a further feature of the invention, in one of the two adjacent printing units, and additional sprocket pair is disposed below a sprocket pair cooperating with an impression cylinder of the one printing unit, the strands of the conveyor system being likewise guided over the additional sprocket pair.

In accordance with an additional feature of the invention, one of the sprocket pairs is fastened onto a shaft of a respective impression cylinder in each of the printing units, and the gripper bridges of the conveyor system revolve with the respective impression cylinder.

In accordance with an added feature of the invention, a respective sprocket pair having double the diameter of cylinders in the printing units is provided in each of the printing units.

In accordance with yet another feature of the invention the conveyor system is a chain conveyor system, and the conveyor strands are conveyor chains.

The control devices can be provided only on one side of the printing units. For example, the arrangement of the control means can be such that the roller levers of the gripper bridges in the first printing unit will always lie on the drive side, and in the second printing unit, always on the operating side.

Other features which are considered as characteristic for the invention are set forth in the appended claims.

Although the invention is illustrated and described herein as embodied in a sheet turning device for small offset printing machines or printing units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 6:
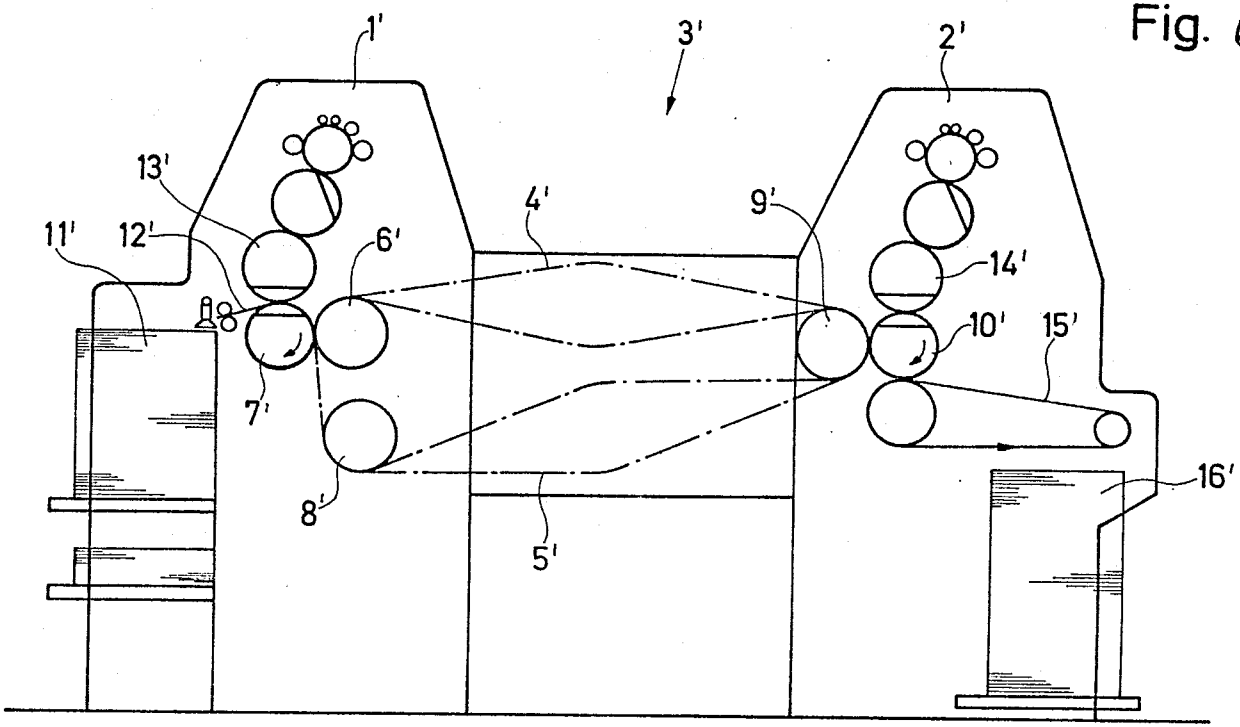
FIG. 6 is a diagrammatic side elevational view of a first form and perfector press with two printing units and a pair of sprockets disposed one above the other in one of the printing units.
Figure 7:
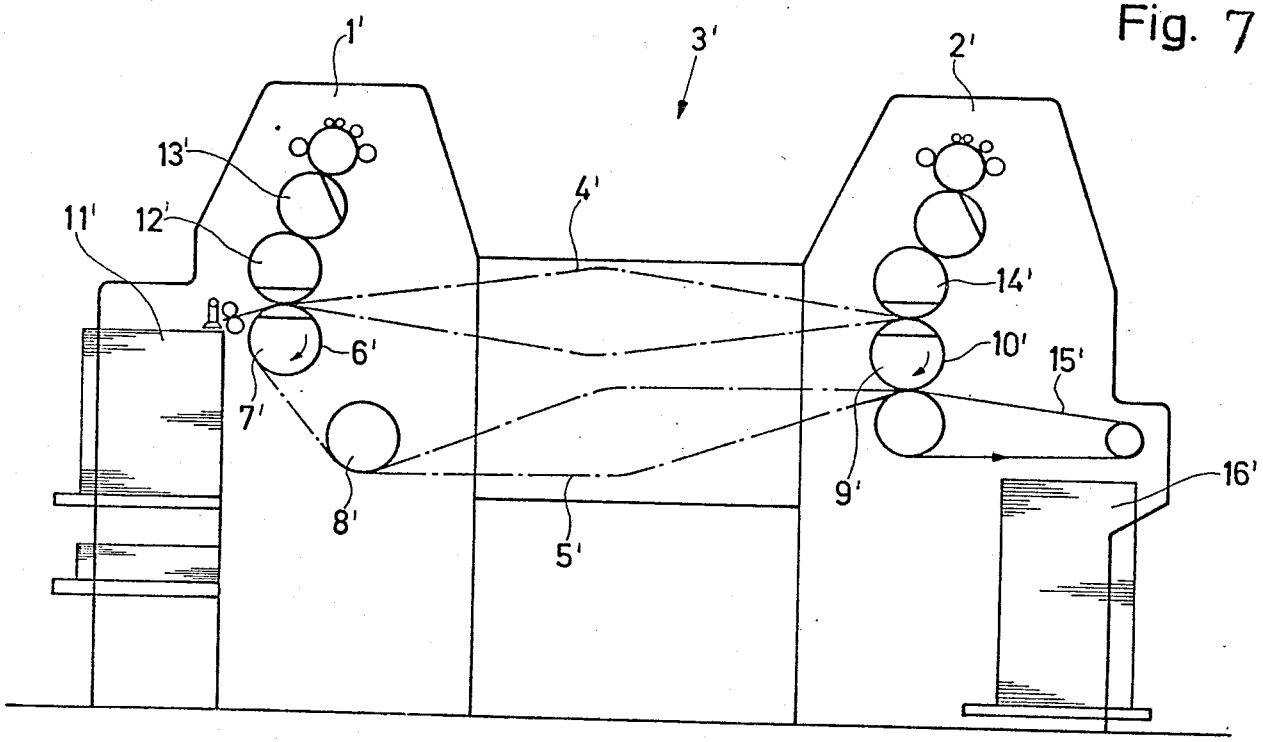
Figure 8:
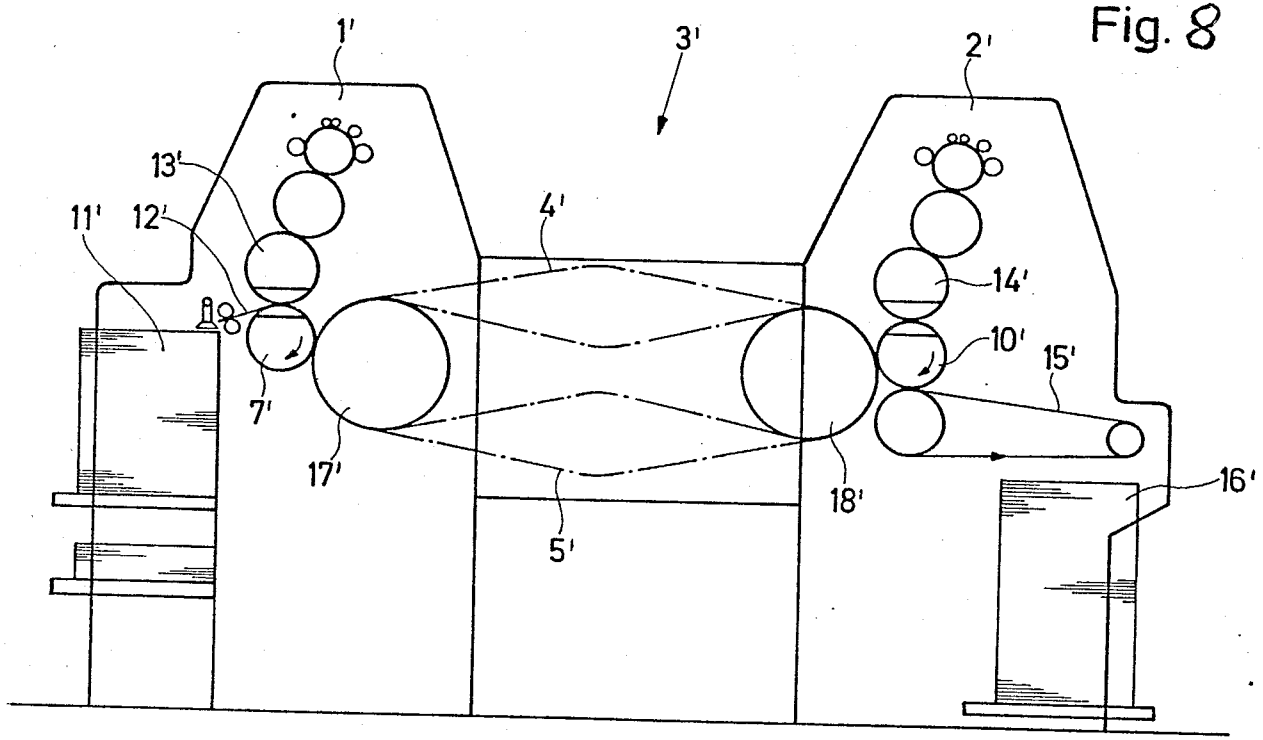

FIG. 7 is a view similar to that of FIG. 6 of another embodiment of the first form and perfector press with two printing units and with sprocket pairs located on the shaft of the impression cylinders of both printing units; and FIG. 8 is a view similar to that of FIG. 6 of yet another embodiment of the first form and perfector press with two printing units and with only one sprocket pair having double the diameter of the printing-unit cylinders being provided in each of the printing units.

Figure 1:
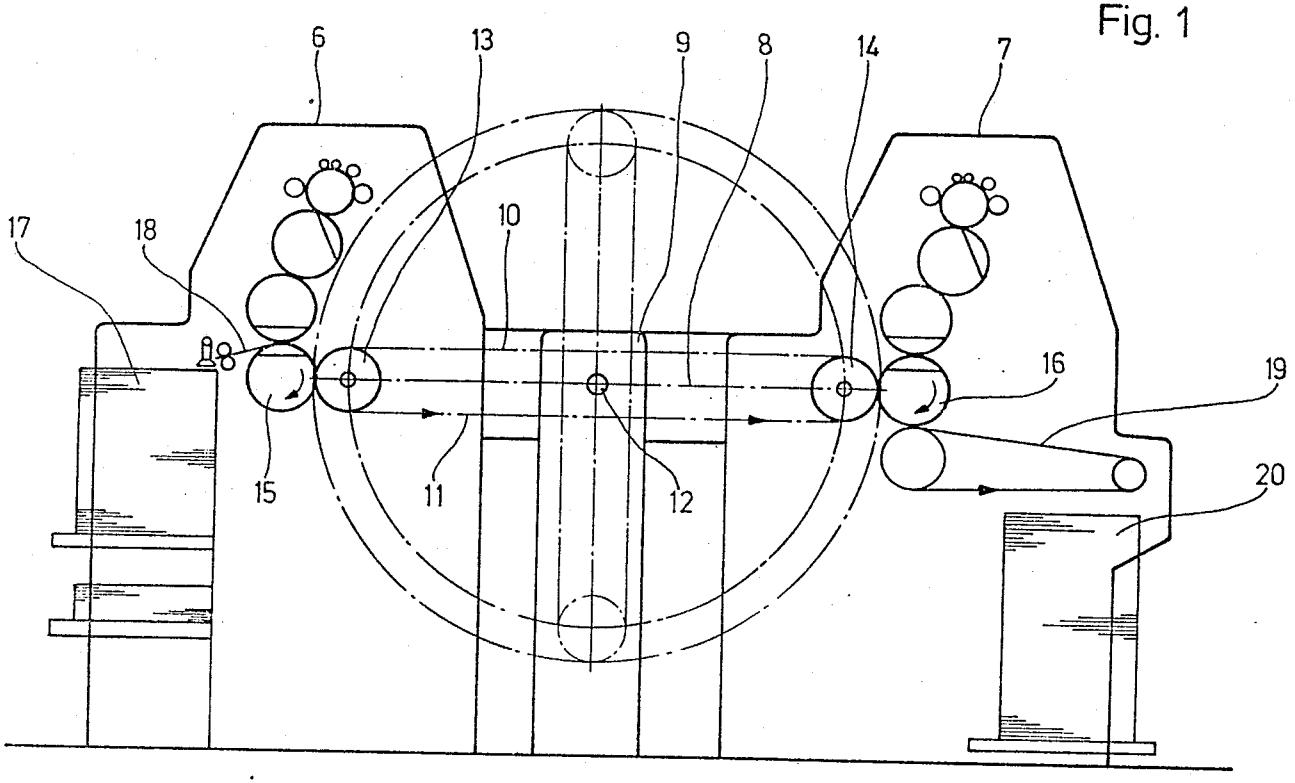
FIG. 1 is a diagrammatic side elevational view of a small offset printing machine convertible from two-color printing to first form and perfector printing.

Referring now to the drawing and, first, particularly to FIG. 1 thereof, there are shown two small offset printing units 6 and 7 linked to one another by, for example, a chain system 8 formed of two endless, parallel-running conveyor chains. This chain system 8 carries sheets from the first small offset printing unit 6 to the second small offset printing unit 7. Between the two small offset printing units 6 and 7, there is disposed a bearing column 9 which carries otherwise non-illustrated side walls of the chain system 8. These side walls are mounted so as to be pivotable about a bearing 12 into two operating positions in such a way that either one part 10 or another part 11 of the chain system 8 is placed into or reaches the lower sheet conveying position.

As shown in FIGS. 2 to 5, the chain system 8 is equipped with five gripper bridges 1 to 5. Two conveyor chains of the chain system 8 are guided by chain sprockets 13 and 14, respectively. Otherwise, non-illustrated grippers of gripper carriages or bridges 1 to 5 are preferably of symmetrical construction, e.g. are in the form of tong grippers.

Figure 2:
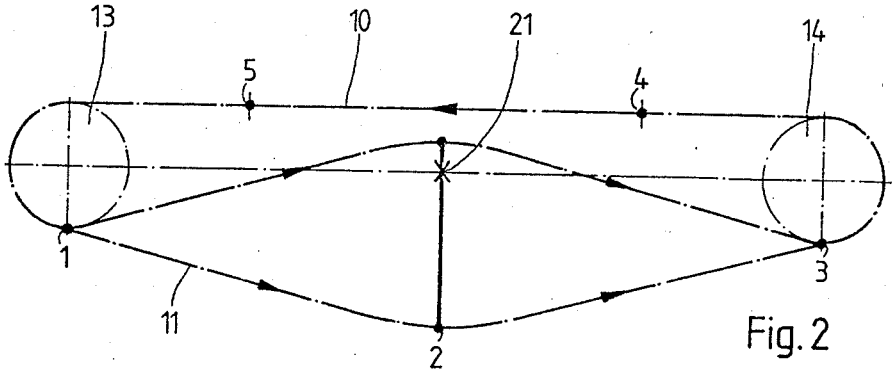
FIGS. 2 to 5 are respective side elevational and plan views of the conveyor system of the small offset printing machine shown in FIG. 1 in two different indexing positions thereof.

As can be seen from FIG. 2, the upper part 10 of the chain system 8 runs straightly or rectilinearly whereas the lower part 11 is twisted into the form of a "Mobius band", which means that the gripper bridges 1 to 5 are rotated or pivoted through 180° between the chain sprockets 13 and 14.

Figure 3:
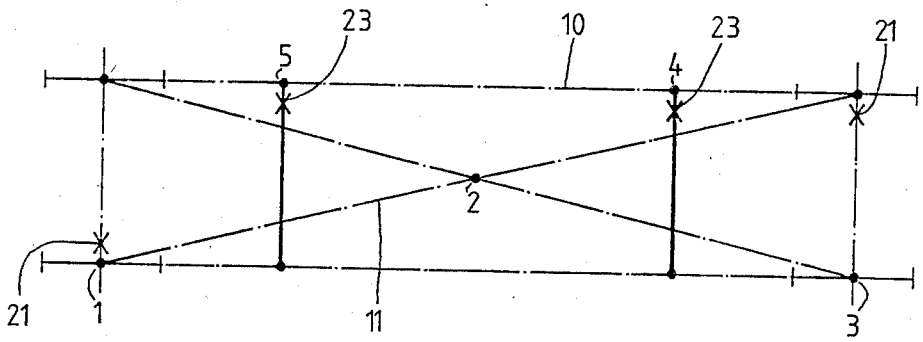
Figure 4:
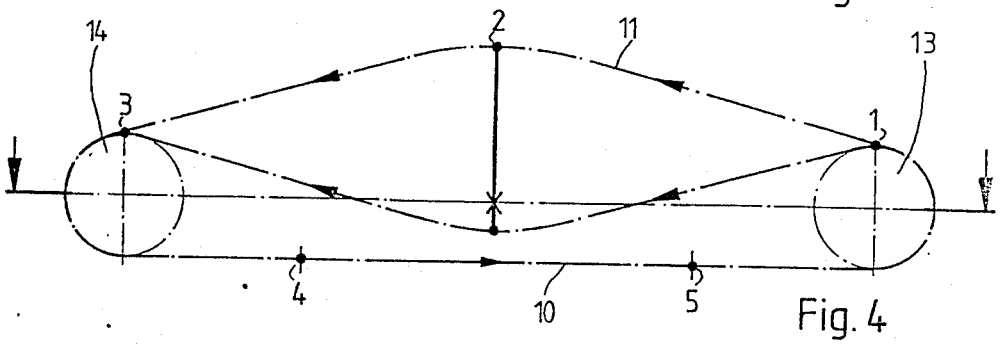
Figure 5:
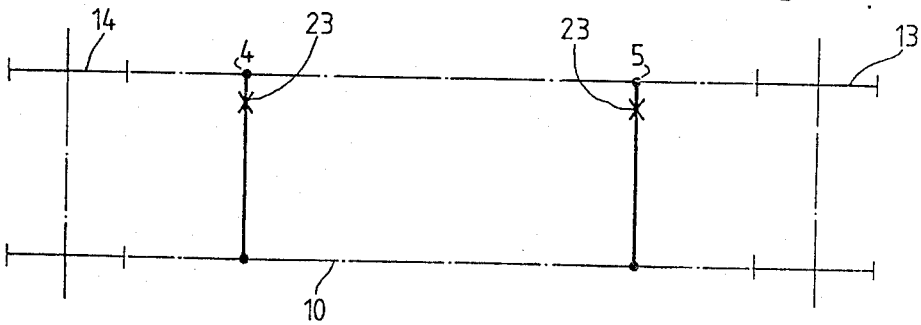

FIG. 3 illustrates the rotation of the gripper carriages or bridges 1 to 5 when the lower part 11 does the conveying. For example, after the point marked by a cross 21 on the gripper bridge 1 has traversed the entire part 11 and arrived at the position of the gripper bridge 3, it will have assumed the position marked at the upper right-hand corner of the figure. Each gripper bridge (in this case gripper bridge 2 will be exactly vertical in the middle of the part 11. When this gripper bridge has finally reached the chain sprockets 14 and has arrived at the location of the gripper bridge 3, it will have again assumed a horizontal position after a turn through 180°. If the gripper bridges 1 to 5 carry a sheet while traversing the part 11, this sheet is then forcibly turned about its longitudinal axis. The sheet held by the tong grippers experiences a rotation about the longitudinal axis thereof.

As mentioned hereinabove, the chains system 8 can be swivelled or pivoted about its bearing 12 through 180°, so that the normal or rectilinear part 10 arrives at the lower sheet conveying position. This indexing position is shown in detail in FIGS. 4 and 5. From both of the latter figures, it is apparent that the chain sprockets 13 and 14 have changed places. The gripper bridges 4 and 5, which are located in the lower part 10, travel without rotation from the chain sprockets 14 to the chain sprockets 13. The cross marking 23 (FIG. 5) shown on gripper bridges 4 and 5 indicates that no rotation of the gripper bridges and turning over of the sheet, respectively, occurs because this marking 23 traverses a path parallel to the chains.

In accordance with the invention, the chain system 8 operates as follows:

A sheet-feeder 18 feeds sheets successively from a feed pile 17 to an impression cylinder 15. After a first printing operation, the chain system 8 accepts this sheet and advances it along the part or section 11. As shown in FIGS. 2 and 3, the sheet experiences a turn about the longitudinal axis thereof before it is fed to the impression cylinder 16 of the second small offset printing unit 7. The turned sheet is printed on its blank reverse side by the second small offset printing unit 7, and is then conveyed by a chain delivery 19 to a delivery pile 20.

If a two-color printing is to be produced, then the chain system 8 has only to be pivoted or swivelled about the pivot bearing 12 in such a manner that the part or section 10 reaches the lower sheet conveying position. The sheet which has been printed once by the impression cylinder 15 is then transported by the chain system 8 along the part or section 10 without being turned about the longitudinal axis thereof. This sheet then receives a second printing on the same side thereof by the impression cylinder 16 of the second small offset printing unit 7, and is then fed to the delivery pile 20 by the chain delivery 19.

Depending upon the indexing position of the chain system 8, the small offset printing machine shown in FIG. 1 is able to print two colors or a single color on the front and reverse sides of a sheet in a single operation. The construction of the chain system 8, as well as the bearing therefor, can be kept very simple. The same applies to the otherwise non-illustrated indexing mechanism.

As aforementioned, the invention is not limited to the aforedescribed embodiment. Thus, the chain system 8 may, for example, be spatially fixed. In such a case, the part of section 11 twisted as a Mobius band would be permanently in the lower sheet conveying position. It is also possible to use other means of traction instead of chains, such as toothed belts, for example. Furthermore, the chain system 8 may, in accordance with the invention, be constructed in such a way that it can be used for temporarily linking two complete small offset printing machines.

The printing unit 1' of a first form and perfector printing machine according to FIG. 6 is linked to the printing unit 2' by a sheet turning device constructed as a chain conveyor system 3'. An upper part 4' of the chain system 3', which is formed of two parallel-running conveyor chains with otherwise non-illustrated gripper bridges, is twisted 180° analogously to a Mobius band. The lower part 5' of the chain system 3' is formed in the same manner. In the first printing unit 1', the conveyor chains of the chain system 3' are guided by a sprocket pair 6' cooperating with the impression cylinder 7'. Below the sprocket pair 6' is another sprocket pair 8' via which the conveyor chains of printing unit 2', on the other hand, only one sprocket pair 9' is provided which cooperates with the impression cylinder 10' of the second printing unit 2'. Due to the arrangement of the additional sprocket pair 8' in the first printing unit 1', the parts 4' and 5' of the chain system 3' extend far removed from one another in the such manner that the gripper bridges standing vertically in the middle of the conveyor stretch and which are not illustrated do not contact one another.

The manner of operation of the aforedescribed small offset printing press for first form and perfector printing is as follows:

From a feed pile 11', a sheet 12' is fed to an impression cylinder 7' where it receives a first impression or printing by means of a blanket cylinder 13'. The printed sheet 12 is surrendered to the chain system 3' and guided around the sprocket pair 8' into the part 5' of the chain system 3'. On this stretch of travel, the sheet 12' conveyed by the chain system 3' is turned about the longitudinal axis thereof before it is surrendered in vicinity of the sprocket pair 9' to the impression cylinder 10'. The sheet 12' fed to the printing unit 2' is thus printed on one side thereof, yet has been accepted turned over so that, in the second printing unit 2', the sheet printed on the underside thereof receives a further impression or printing on the empty sheet side by a blanket cylinder 14'. The sheet 12' then printed on both sides thereof is surrendered by the impression cylinder 10' of the printing unit 2' to a chain delivery 15' which feeds the sheet 12' to a delivery pile 16'.

The gripper bridge which has fed the sheet 12' to the impression cylinder 10' of the second printing unit 2' is then again turned through 180° in the upper part 4' of the chain system 3', so that a roller lever thereof, at the level of the sprocket pair 6' comes to lie again on the same side as for the previously effected sheet take-over by the impression cylinder 7'. The control means can thus be relatively simply and economically constructed.

The embodiment of the first form and perfector printing machine shown in FIG. 2 deviates from that of FIG. 1 only by a different type of guidance for the conveyor chains of the chain system 3'. In both printing units 1' and 2', the sprocket pairs 6' and 9', respectively, are arranged directly on the shafts of the associated impression cylinder 7' and 10', respectively. This construction of the chain guidance is particularly space-saving. The gripper bridges then forcibly run around with the impression cylinder 7' and 10', respectively, in the region of the sheet take-over or surrender. Due to the reversal of the rotary direction of the chain system 3', the upper part 4' of the chain system 3' conveys the sheet to be turned over from the printing unit 1' to the printing unit 2'. After the perfector printing has taken place in the printing unit 2', the respective gripper bridge guiding the sheet 12' surrenders the printed sheet directly to the chain delivery 15'.

Yet another different embodiment of the chain guidance of the chain system 3' is exhibited by the first form and perfector printing machine of FIG. 3. This embodiment is distinguished by the fact that only one sprocket pair 17', 18', respectively, is provided in the printing units 1' and 2'. In order that the two parts 4' and 5' of the chain system 3' are disposed far enough from one another, however, so that the vertically guided gripper bridges in the middle of the transport stretch are not in mutual contact, the sprocket pairs 17' and 18' have a diameter double that of the printing-unit cylinders. This chain guidance is also exceptionally space-saving. Transport or conveyance of the sheet to be turned over is then again assumed by the lower part 5' of the chain system 3'.

Naturally, within the scope of the invention, further variations of the chain guidance are conceivable. For example, the various embodiments described hereinbefore can also be combined with one another.

There is claimed:

1. Sheet turning device for small offset printing machines, comprising a conveyor system with gripper bridges linking two adjacent small offset printing machines for transporting a sheet having at least one printing performed thereon from one of the small offset printing machines to the other, said conveyor system being formed of two endless conveyor strands extending parallel to one another and being twisted in the form of a Mobius band, one part of said conveyor system extending between pairs of sprockets and having the Mobius-band twist formed therein, while the other part of said conveyor system is located opposite said one part and extends rectilinearly, so that the sheet transported in the region of said one part of said conveyor system is turned around the longitudinal axis thereof as it is being transported, said conveyor system being arranged so as to be pivotable through 180° into two operating positions, by pivoting the part having the Mobius-band twist therein into a first form and perfector printing position of the small offset printing machine, and by pivoting the rectilinear part into a multicolor single-side printing position.

2. Sheet turning device according to claim 1, wherein said gripper bridges of said conveyor system, are furnished with tong grippers.

3. Sheet turning device according to claim 1, wherein said conveyor system is a chain conveyor system, and said conveyor strands are conveyor chains.

4. Sheet turning device for small offset printing machines, comprising a conveyor system with gripper bridges linking two adjacent printing units for transporting a sheet having at least one printing performed thereon from one of the printing units to the other, said conveyor system being formed of two endless conveyor strands extending parallel to one another and being twisted in the form of a Mobius band, both an upper and a lower part of said conveyor system extending between respective pairs of sprockets and having a Mobius-band twist of 180° formed therein, and wherein in one of the two adjacent printing units, and additional sprocket pair is disposed below a sprocket pair cooperating with an impression cylinder of the one printing unit, said strands of said conveyor system being likewise guided over said additional sprocket pair.

5. Sheet turning device according to claim 4, wherein one of said sprocket pairs is fastened onto a shaft of a respective impression cylinder in each of said printing units, and said gripper bridges of said conveyor system revolve with the respective impression cylinder.

6. Sheet turning device according to claim 4, wherein a respective sprocket pair having double the diameter of cylinders in the printing units is provided in each of the printing units.

7. Sheet turning device according to claim 4, wherein said conveyor system is a chain conveyor system and said conveyor strands are conveyor chains.

* * * * *